US009540823B2

(12) United States Patent
Mankowski

(10) Patent No.: US 9,540,823 B2
(45) Date of Patent: Jan. 10, 2017

(54) RIDGE VENT WITH EXTERNAL-FLEXION VANES

(71) Applicant: Quality Edge, Inc., Walker, MI (US)

(72) Inventor: John Mankowski, Fall City, WA (US)

(73) Assignee: Quality Edge, Inc., Walker, MI (US)

( * ) Notice: Subject to any disclaimer, the term of this patent is extended or adjusted under 35 U.S.C. 154(b) by 895 days.

(21) Appl. No.: 13/836,297

(22) Filed: Mar. 15, 2013

(65) Prior Publication Data

US 2014/0273808 A1 Sep. 18, 2014

(51) Int. Cl.
*E04D 13/17* (2006.01)

(52) U.S. Cl.
CPC ..... *E04D 13/174* (2013.01)

(58) Field of Classification Search
CPC ..... E04D 13/174; E04D 1/3402; E04D 1/30; E04D 13/176
USPC ..... 52/198, 199; 454/365
See application file for complete search history.

(56) References Cited

U.S. PATENT DOCUMENTS

| | | | |
|---|---|---|---|
| 2,799,214 | A | 7/1957 | Roose |
| 3,058,542 | A | 10/1962 | Rogalla |
| 4,221,628 | A | 9/1980 | Rosenberg et al. |
| 4,341,304 | A | 7/1982 | Diller |
| 4,676,147 | A | 6/1987 | Mankowski |
| 4,817,506 | A | 4/1989 | Cashman |
| 4,903,445 | A | 2/1990 | Mankowski |
| 4,907,499 | A | 3/1990 | James |
| 4,924,761 | A | 5/1990 | MacLeod et al. |
| 4,957,037 | A | 9/1990 | Tubbesing et al. |
| 5,009,149 | A | 4/1991 | MacLeod et al. |
| 5,052,286 | A | 10/1991 | Tubbesing et al. |
| 5,060,431 | A | 10/1991 | MacLeod et al. |
| 5,070,771 | A | 12/1991 | Mankowski |
| 5,095,810 | A | 3/1992 | Robinson |
| 5,122,095 | A | 6/1992 | Wolfert |
| 5,149,301 | A | 9/1992 | Gates |

(Continued)

OTHER PUBLICATIONS

Watts et al., "The Influence of Passive, Leading Edge Tubercles on Wing Performance," presented at the 12th Int. Symp. Unmanned Untethered Submersible Technology, Autonomous Undersea Systems Inst., Durham, NH, 2001 (9 pages).

*Primary Examiner* — Steven B McAllister
*Assistant Examiner* — Ko-Wei Lin
(74) *Attorney, Agent, or Firm* — Price Heneveld LLP

(57) ABSTRACT

A vent system includes a plurality of vent panels. Each vent panel includes a body having first and second sidewalls and first and second end walls. Each of the first and second end walls includes a first set of lateral vents and a second set of lateral vents. The first set of lateral vents is disposed at a first angle relative to the first end wall and a second set of lateral vents is disposed at a second angle relative to the second end wall. A first vented portion is disposed between the first sidewall and the body. A second vented portion is disposed between the second sidewall and the body. The first and second vented portions each include laterally-extending vent supports that define a plurality of vent openings that support the flow of air therethrough. A plurality of flexure vanes are disposed on each of the first and second sidewalls. A flexure channel is disposed adjacent to each of the plurality of flexure vanes that allow for some flexure of the vent panel. A plurality of weep holes are disposed on each of the first and second sidewalls.

17 Claims, 9 Drawing Sheets

(56) References Cited

U.S. PATENT DOCUMENTS

| | | | | |
|---|---|---|---|---|
| 5,236,340 | A | 8/1993 | Hall et al. | |
| 5,288,269 | A | 2/1994 | Hansen | |
| 5,457,920 | A | 10/1995 | Waltz | |
| 5,458,538 | A | 10/1995 | MacLeod et al. | |
| 5,535,558 | A | 7/1996 | Rieke et al. | |
| 5,593,035 | A | 1/1997 | Taylor et al. | |
| 5,660,353 | A | 8/1997 | Adams, Jr. et al. | |
| 5,772,502 | A | 6/1998 | Smith | |
| 5,819,935 | A | 10/1998 | Lawson | |
| 5,960,904 | A | 10/1999 | Ullmann | |
| 5,996,300 | A | 12/1999 | Hamlin | |
| 6,003,668 | A | 12/1999 | Joyce | |
| 6,039,646 | A | 3/2000 | Sells | |
| 6,128,869 | A | 10/2000 | Brotherton et al. | |
| 6,227,963 | B1 | 5/2001 | Headrick | |
| 6,233,887 | B1 | 5/2001 | Smith | |
| 6,260,315 | B1 * | 7/2001 | Smith | E04D 13/176 454/365 |
| 6,269,905 | B1 | 8/2001 | Smith | |
| 6,277,024 | B1 | 8/2001 | Coulton | |
| 6,361,434 | B1 | 3/2002 | Brandon | |
| 6,371,847 | B2 | 4/2002 | Headrick | |
| 6,374,568 | B1 | 4/2002 | Hamlin | |
| 6,491,581 | B1 | 12/2002 | Mankowski | |
| 6,547,126 | B2 | 4/2003 | Freiborg et al. | |
| 6,579,171 | B2 | 6/2003 | Lawless, III et al. | |
| 6,684,581 | B2 | 2/2004 | Robinson et al. | |
| 6,769,223 | B2 | 8/2004 | Alderman | |
| 6,881,144 | B2 | 4/2005 | Hansen et al. | |
| 6,908,007 | B2 | 6/2005 | Hrdlicka | |
| 6,991,535 | B2 * | 1/2006 | Ciepliski | E04D 13/176 454/365 |
| 7,024,828 | B2 | 4/2006 | Headrick | |
| 7,165,363 | B2 | 1/2007 | Headrick, II et al. | |
| 7,219,473 | B2 | 5/2007 | Mantyla et al. | |
| 7,365,266 | B2 | 4/2008 | Heckeroth | |
| 7,537,518 | B2 | 5/2009 | Villela et al. | |
| 7,562,498 | B2 | 7/2009 | Galeazzo et al. | |
| 7,662,037 | B2 * | 2/2010 | Polston | E04D 13/174 454/365 |
| 7,766,735 | B2 | 8/2010 | Ciepliski et al. | |
| 7,814,715 | B2 | 10/2010 | Coulton et al. | |
| 7,874,451 | B2 | 1/2011 | Bel | |
| 8,069,621 | B2 | 12/2011 | Mantyla et al. | |
| 2002/0144485 | A1 | 10/2002 | Wagner | |
| 2004/0237428 | A1 | 12/2004 | Headrick et al. | |
| 2006/0035582 | A1 | 2/2006 | Collister et al. | |
| 2006/0121845 | A1 * | 6/2006 | Sells | F24F 7/02 454/365 |
| 2007/0267310 | A1 | 11/2007 | Berkowitz et al. | |
| 2008/0287053 | A1 | 11/2008 | Carlson et al. | |
| 2008/0287054 | A1 | 11/2008 | Carlson et al. | |
| 2009/0049769 | A1 | 2/2009 | Kaseda | |
| 2009/0130969 | A1 | 5/2009 | Grisham et al. | |
| 2009/0233541 | A1 | 9/2009 | Holland et al. | |
| 2009/0249740 | A1 | 10/2009 | Crookston | |
| 2010/0112932 | A1 * | 5/2010 | Grubka | E04D 13/174 454/365 |
| 2010/0144266 | A1 | 6/2010 | Lowe et al. | |
| 2011/0195655 | A1 | 8/2011 | Holland et al. | |
| 2011/0302852 | A1 | 12/2011 | Grubka et al. | |

* cited by examiner

RIDGE VENT WITH EXTERNAL-FLEXION VANES

CROSS-REFERENCE TO RELATED APPLICATIONS

This application is related to U.S. patent application Ser. No. 13/836,158, filed on Mar. 15, 2013, entitled "ROLLABLE RIDGE VENT PANEL," and U.S. patent application Ser. No. 13/835,965, filed on Mar. 15, 2013, entitled "ROLLED RIDGE VENT DISPENSER," the entire disclosures of which are hereby incorporated herein by reference.

BACKGROUND OF THE INVENTION

The present invention generally relates to a ridge vent, and more specifically, to a ridge vent with external-flexion vanes for a roof of a building.

SUMMARY OF THE PRESENT INVENTION

One aspect of the present invention includes a vent system having a plurality of vent panels. Each vent panel includes a body having first and second sidewalls and first and second end walls. Each of the first and second end walls includes a first set of lateral vents and a second set of lateral vents. The first set of lateral vents is disposed at a first angle relative to the first end wall and a second set of lateral vents is disposed at a second angle relative to the second end wall. A first vented portion is disposed between the first sidewall and the body. A second vented portion is disposed between the second sidewall and the body. The first and second vented portions each include laterally-extending vent supports that define a plurality of vent openings that support the flow of air therethrough. A plurality of flexure vanes are disposed on each of the first and second sidewalls. A flexure channel is disposed adjacent to each of the plurality of flexure vanes that allow for some flexure of the vent panel. A plurality of primary buttresses are disposed in a parallel arrangement on an underside of the plurality of vent panels, wherein each of the plurality of primary buttresses is disposed substantially normal to the body. A plurality of secondary buttresses are disposed parallel to the plurality of primary buttresses on the underside of the plurality of vent panels. The primary and secondary buttresses are disposed in an alternating arrangement to provide increased flexibility to the first and second vented portions and the plurality of flexure vanes. A plurality of weep holes are disposed on each of the first and second sidewalls.

Another aspect of the present invention includes a vent system having a plurality of vent panels. Each vent panel includes a body having first and second sidewalls and first and second end walls. Each of the first and second end walls includes a first set of lateral vents and a second set of lateral vents. The first set of lateral vents is disposed at a first angle relative to the first end wall and a second set of lateral vents is disposed at a second angle relative to the second end wall. A first vented portion is disposed between the first sidewall and the body. A second vented portion is disposed between the second sidewall and the body. The first and second vented portions each include laterally-extending vent supports that define a plurality of vent openings that support the flow of air therethrough. A plurality of flexure vanes are disposed on each of the first and second sidewalls. A flexure channel is disposed adjacent to each of the plurality of flexure vanes that support a flexion of a plurality of vent panels. The plurality of flexure vanes define a scalloped bottom side edge of the vent system. A plurality of primary buttresses are disposed in a parallel arrangement on an underside of the plurality of vent panels. Each of the plurality of primary buttresses is disposed substantially normal to the body.

Yet another aspect of the present invention includes a vent system having a plurality of vent panels. Each vent panel includes a body having a top wall and first and second sidewalls. The top wall includes a bottom surface and a top surface. The first and second sidewalls extend from the top wall at an angle greater than 90 degrees from the bottom surface of the top wall. A first vented portion is disposed between the first sidewall and the body. A second vented portion is disposed between the second sidewall and the body. The first and second vented portions each include laterally-extending arcuate vent supports that define a plurality of arcuate vent openings. A plurality of flexure vanes are disposed on each of the first and second sidewalls. A flexure channel is disposed adjacent to each of the plurality of flexure vanes that support a flexion of a plurality of vent panels, and wherein the plurality of flexure vanes define a scalloped bottom side edge of the vent system. A plurality of primary buttresses are disposed in a parallel arrangement on an underside of the plurality of vent panels. Each of the plurality of primary buttresses is disposed substantially normal to the body.

These and other aspects, objects, and features of the present invention will be understood and appreciated by those skilled in the art upon studying the following specification, claims, and appended drawings.

DETAILED DESCRIPTION OF EMBODIMENTS

Figure 1:
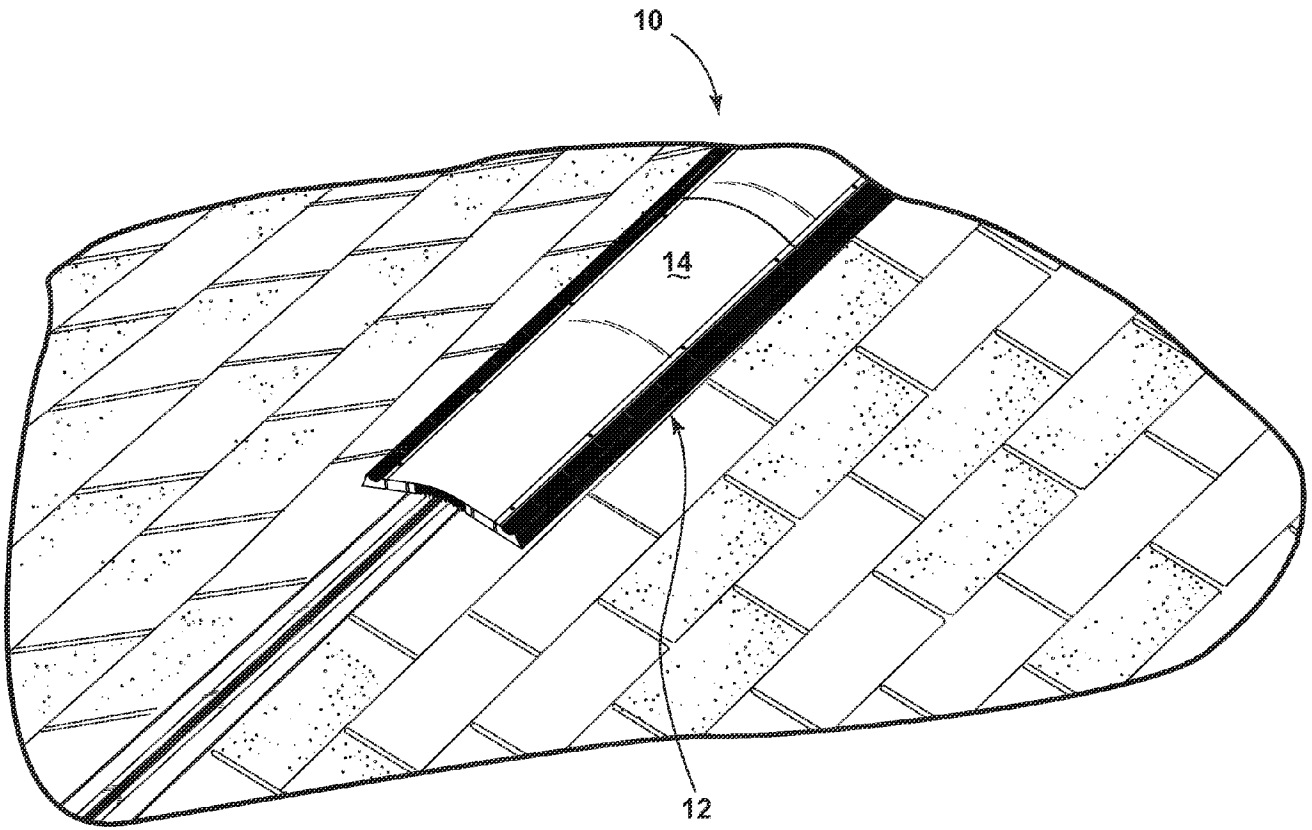
FIG. 1 is a top perspective view of one embodiment of a ridge vent panel of the present invention after installation.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
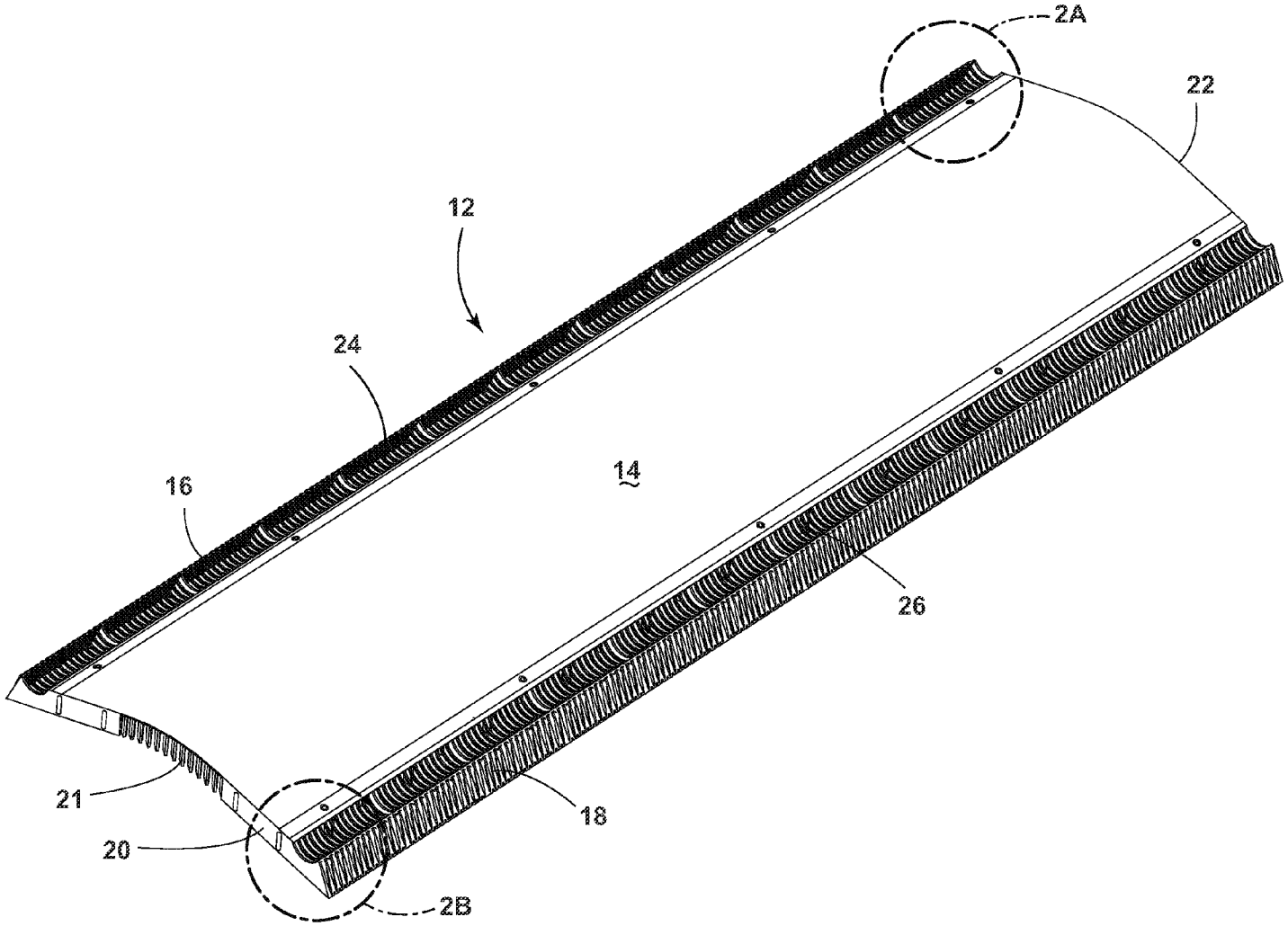
FIG. 2 is a top perspective view of the ridge vent panel of FIG. 1.
Figure 2B:
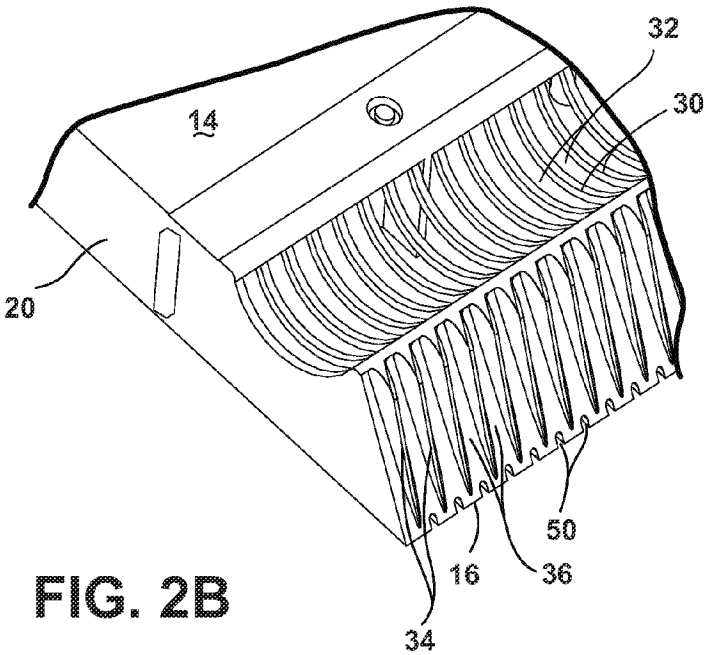
FIG. 2B is a partial top perspective view of area 2B of FIG. 2.
Figure 2A:
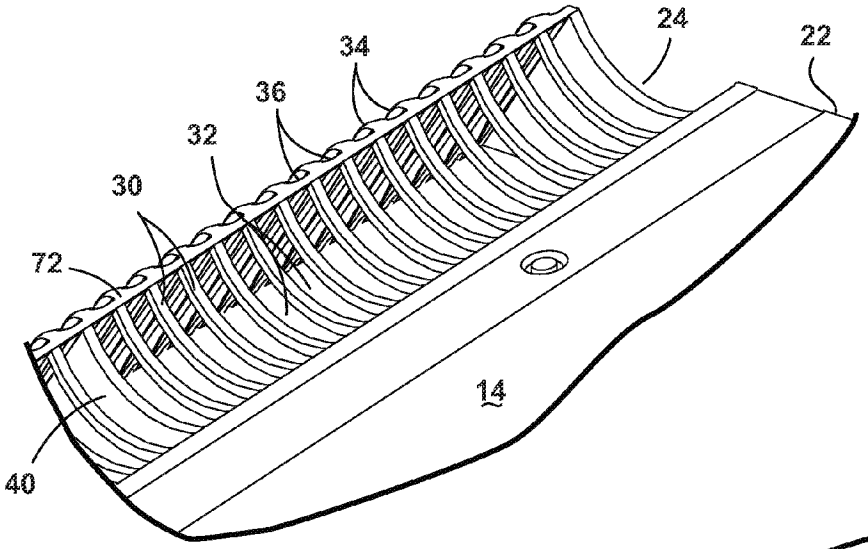
FIG. 2A is a partial top perspective view of area 2A of FIG. 2.

Referring to FIGS. 1 and 2, reference numeral 10 generally designates a vent system having a plurality of vent panels 12. Each vent panel 12 includes a body 14 having first and second sidewalls 16, 18 and first and second end walls 20, 22. Each of the first and second end walls 20, 22 includes a first set of lateral vents 21 and a second set of lateral vents 23, respectively. A first vented portion 24 is disposed between the first sidewall 16 and the body 14. A second vented portion 26 is disposed between the second sidewall 18 and the body 14. The first and second vented portions 24, 26 each include laterally-extending vent supports 30 that define a plurality of vent openings 32 that support the flow of air therethrough. A plurality of flexure vanes 34 are disposed on each of the first and second sidewalls 16, 18. A flexure channel 36 is disposed adjacent to each of the plurality of flexure vanes 34 that allow for some flexure. A plurality of primary buttresses 40 are disposed in a parallel arrangement on an underside of the body 14, wherein each of the plurality of primary buttresses 40 extend in a direction perpendicular to the body 14. A plurality of secondary buttresses 42 are disposed parallel to the plurality of primary buttresses 40 on the underside of the body 14. The plurality of primary and secondary buttresses 40, 42 are disposed in an alternating arrangement to provide increased flexibility to the first and second vented portions 24, 26 and the plurality of flexure vanes 34. A plurality of weep holes 50 are disposed on each of the first and second sidewalls 16, 18.

Referring again to FIGS. 1 and 2, the vent panel 12 is generally configured to extend over a ridge line of a roof. The flexibility of the vent panel 12 allows for the vent panel 12 to extend over any of a variety of angled roofs and still perform optimally. The first and second end walls 20, 22 include non-vented portions 51 that provide some rigidity to the vent panel 12. At the same time, each of the first and second end walls 20, 22 also garner some limited flexibility from the first and second sets of lateral vents 21, 23. The first and second lateral vents 21, 23 allow for air to travel into and out of the vent panel 12, thereby minimizing excessive thermal differentiation above and below the ridge panel 12.

Figure 3:
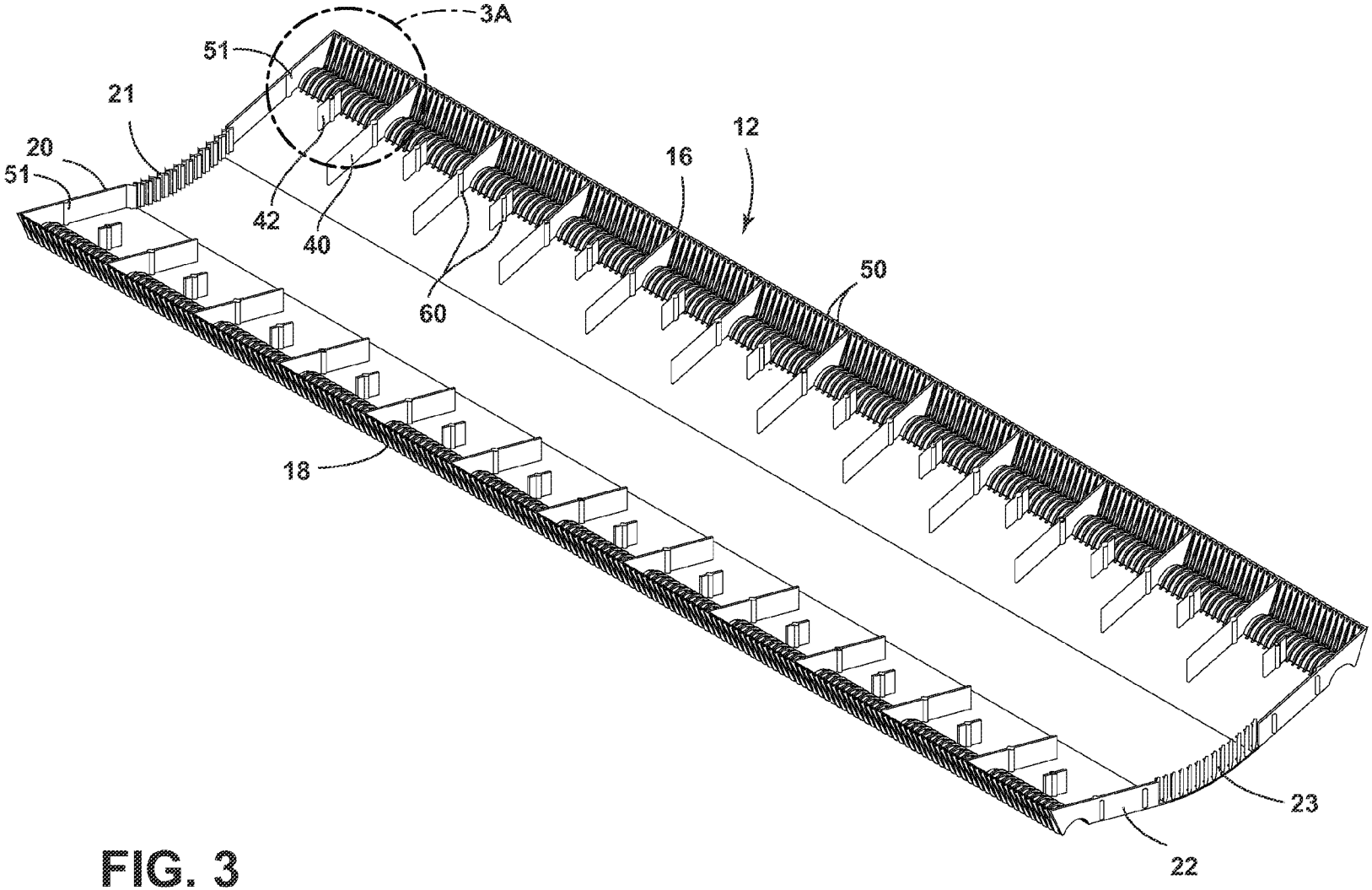
FIG. 3 is a bottom perspective view of the ridge vent panel of FIG. 1.
Figure 3A:
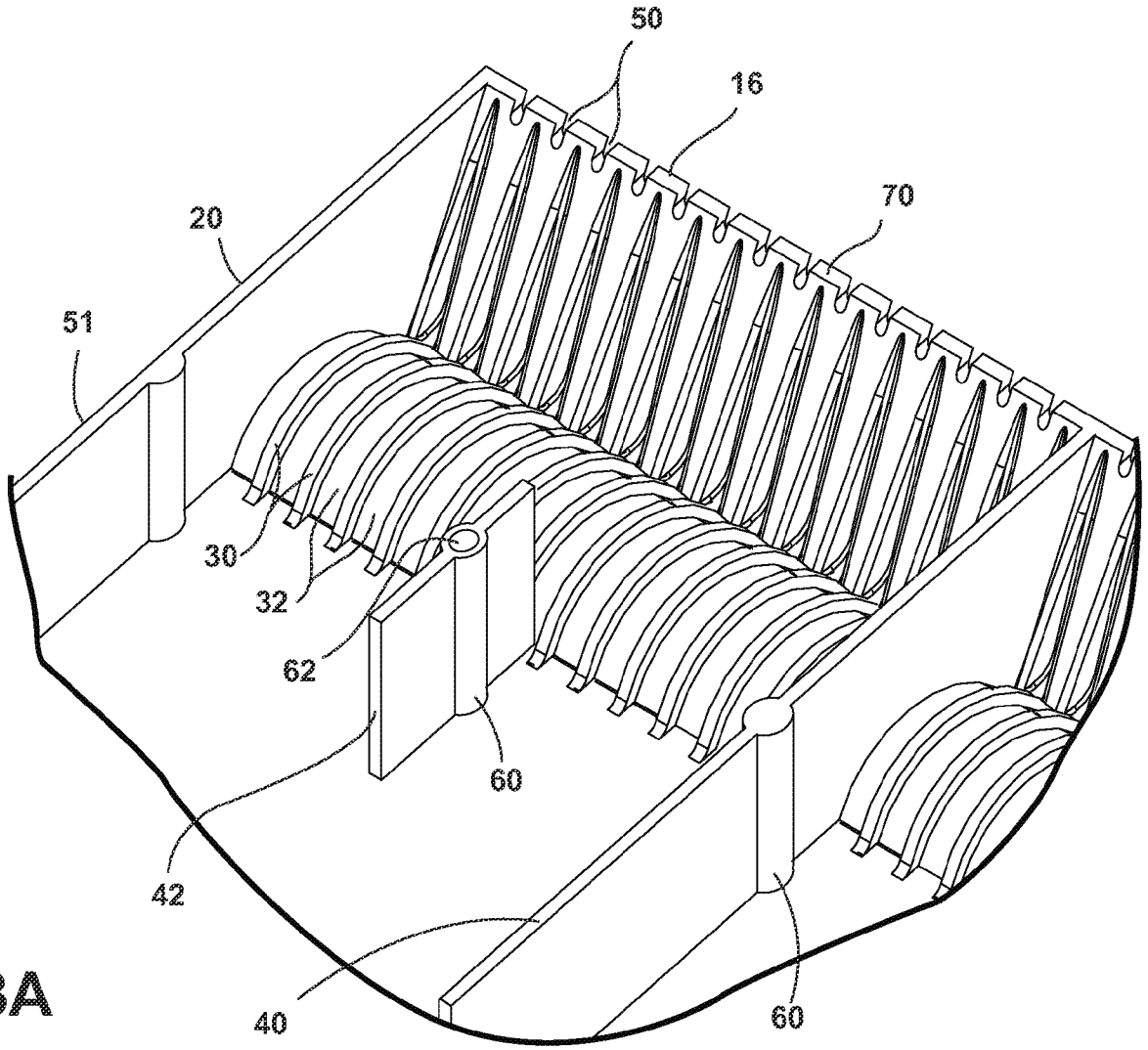
FIG. 3A is a partial top perspective view of area 3A of FIG. 3.
Figure 4:
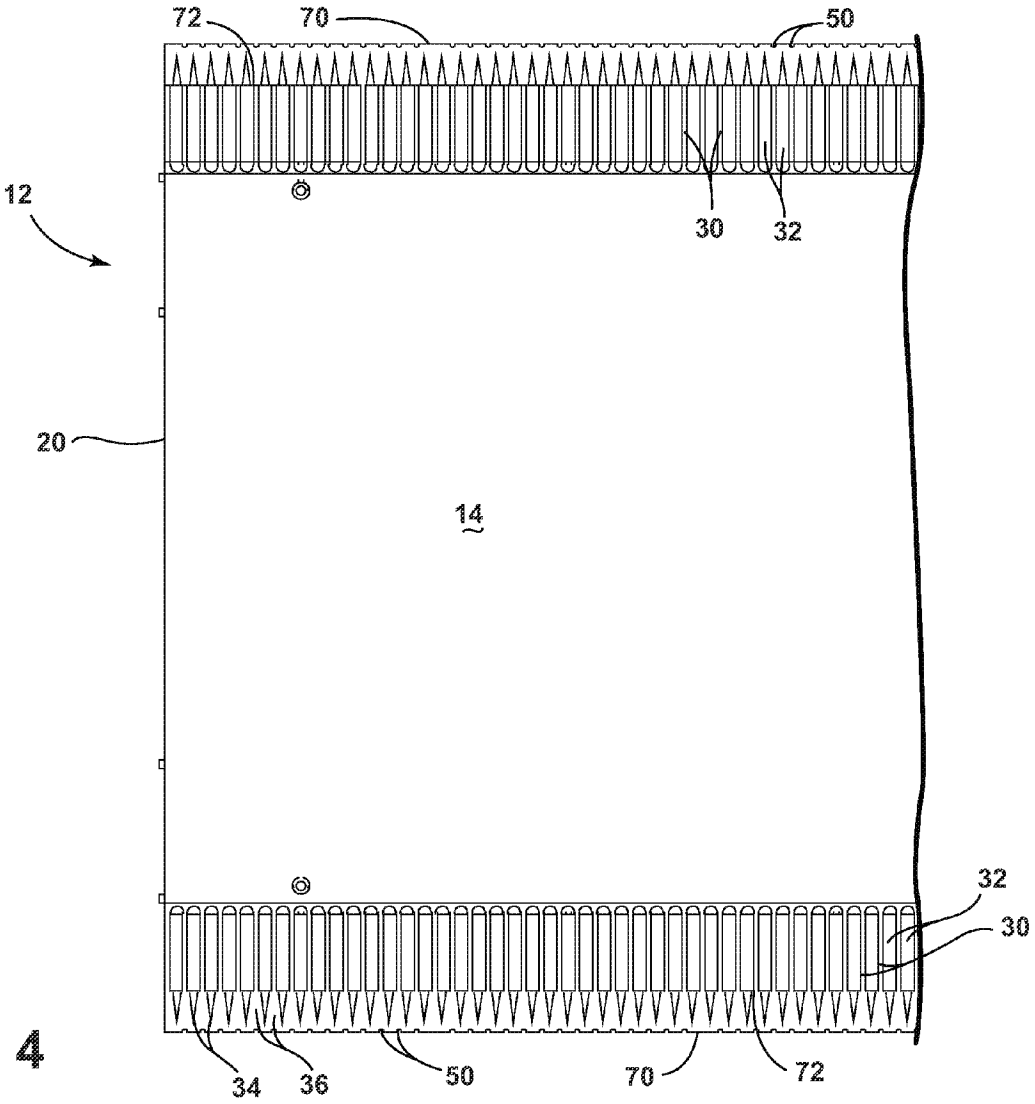
FIG. 4 is a partial top plan view of the ridge vent panel of FIG. 1.
Figure 5:
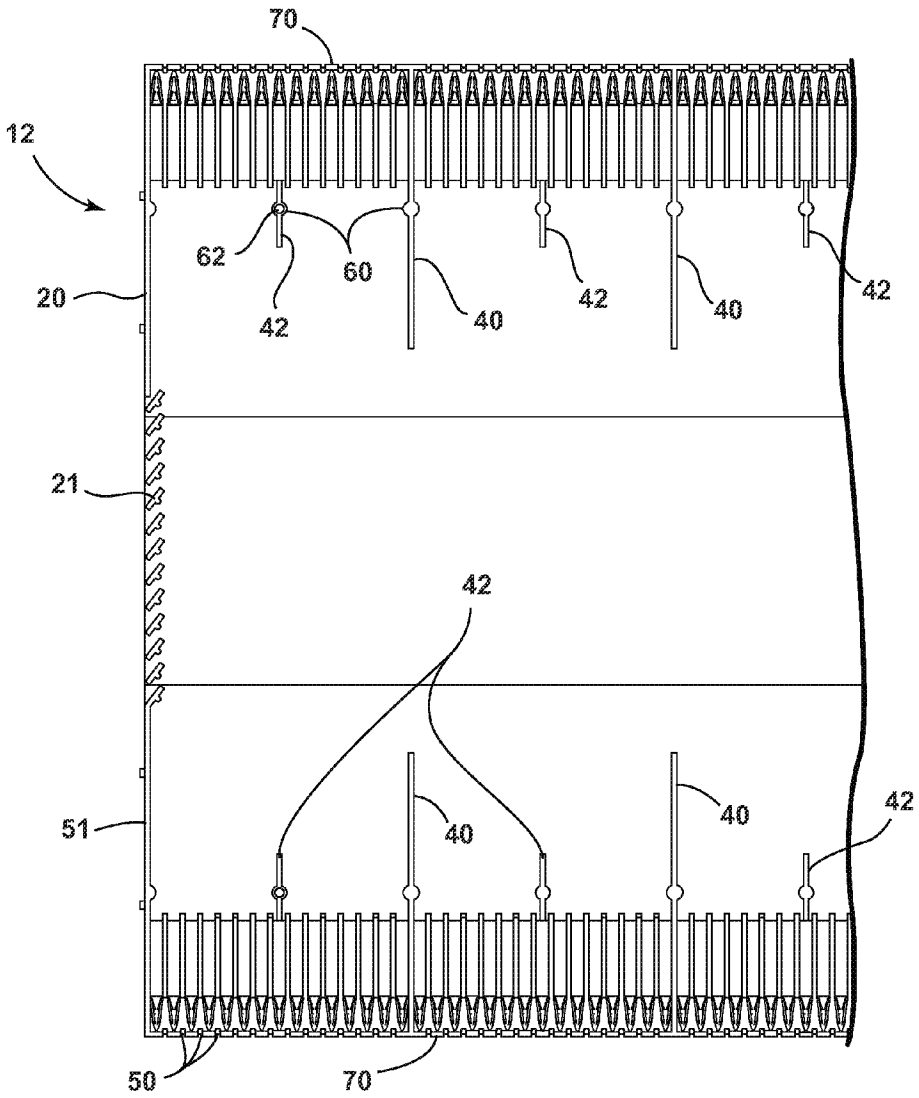
FIG. 5 is a partial bottom plan view of the ridge vent panel of FIG. 1.
Figure 6:
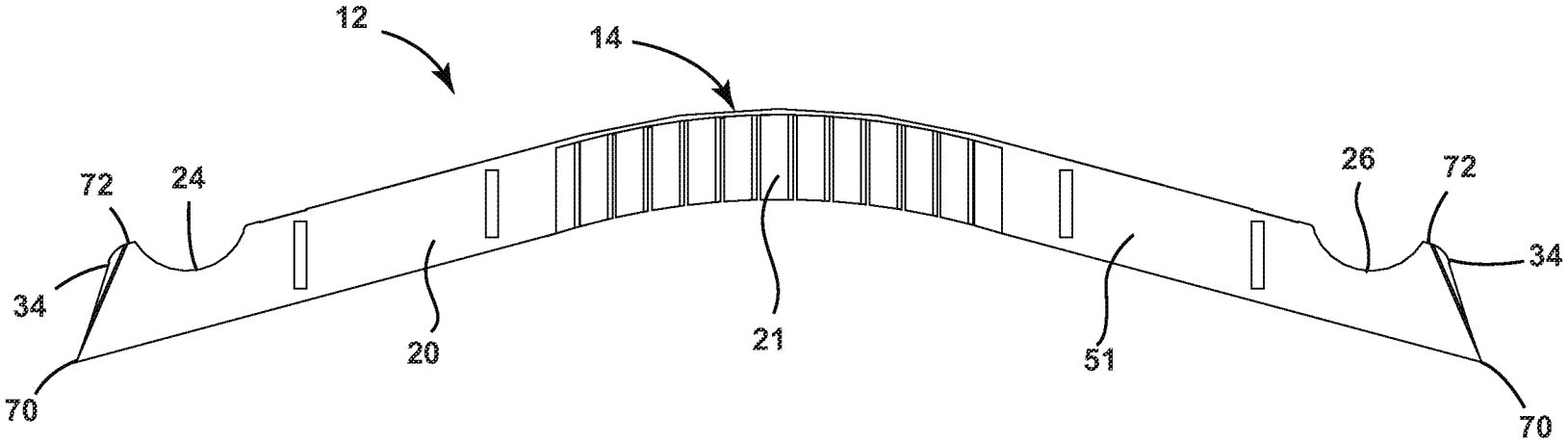
FIG. 6 is an end elevational view of the ridge vent panel of FIG. 1.
Figure 7:
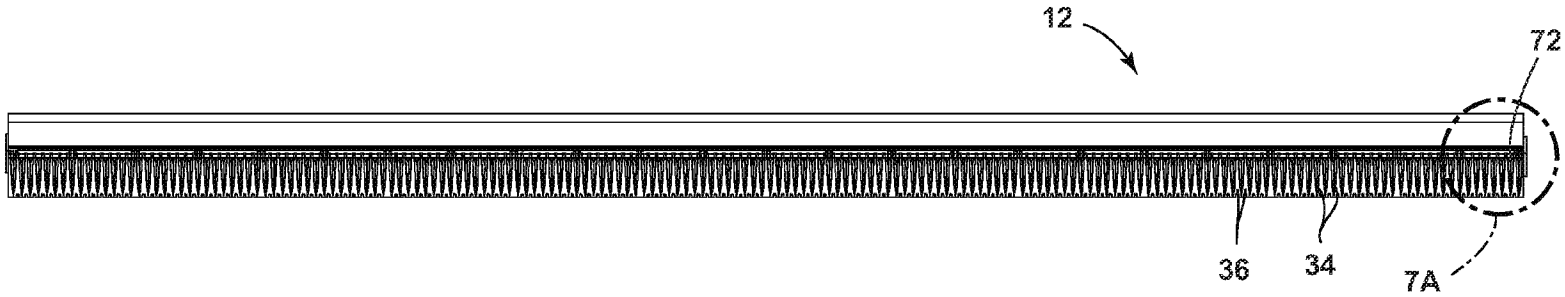
FIG. 7 is a side elevational view of the ridge vent panel of FIG. 1.
Figure 7A:
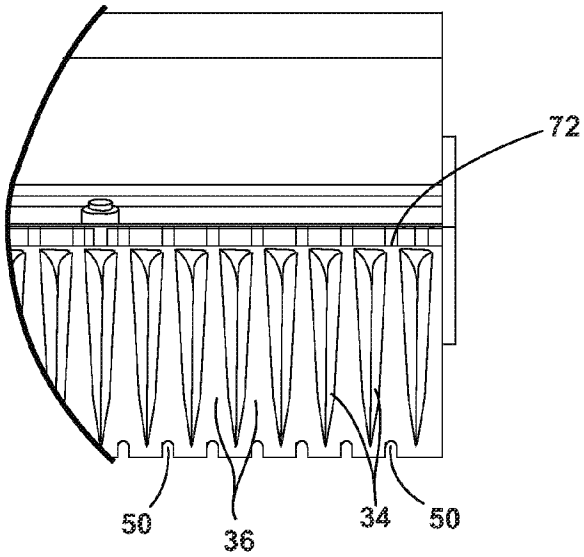
FIG. 7A is a partial side elevational view of area 7A of FIG. 7.

As noted in FIGS. 2 and 3, the first and second vented portions 24, 26 include a concave configuration, resulting from the laterally-extending vent supports 30, which include an arcuate construction. The laterally-extending vent supports 30 are spaced to thereby define the plurality of vent openings 32. The plurality of vent openings 32 also allow movement of air therethrough. The laterally-extending vent supports 30 have a generally arcuate construction and are concave up, as illustrated in FIGS. 3A and 3B. However, it will be understood that the laterally-extending vent supports 30 could also be concave down, linear, polygonal, etc. In the illustrated embodiment, the plurality of vent openings 32 have a width that is greater than the laterally-extending vent supports 30. However, it will be understood by one having ordinary skill in the art that these widths could vary.

As illustrated in FIG. 3A, the plurality of weep holes 50 extend along a bottom edge of the first and second sidewalls 16, 18. The plurality of weep holes 50 allow for moisture that collects under the vent panel 12 to drain from the vent panel 12 outward along a roof surface. In addition, the plurality of primary and secondary buttresses 40, 42 are shown each with an enlarged cylindrical mid-portion 60. In the illustrated embodiment, the plurality of secondary buttresses 42 include a fastening aperture 62 through the enlarged cylindrical mid-portion, which is configured to receive a fastener securing the vent panel 12 to a roof. In other embodiments, it is contemplated that the plurality of primary buttresses 40 may include this feature, or that both of the plurality of primary and secondary buttresses 40, 42 may include this feature.

In addition, as shown in FIGS. 2-3A, the plurality of flexure vanes 34 extend along each of the first and second sidewalls 16, 18 of the vent panel 12. It is contemplated that a top portion of each of the flexure vanes may be open to increase air flow through the vent panel 12. The plurality of flexure vanes 34 taper outwardly from a top edge of each of the first and second sidewalls 16, 18 and extend outwardly until terminating proximate a bottom edge of the first and second sidewalls 16, 18. Each of the plurality of flexure vanes 34 has a substantially triangular cross-section with the total size of the area of the cross-section increasing as the flexure vane 34 extends from a bottom edge 70 of the first and second sidewalls 16, 18 to the top edge 72 of the first and second sidewalls 16, 18. As a consequence of the configuration of the plurality of flexure vanes 34, it is contemplated, in some embodiments, that the plurality of flexure vanes 34 may define a scalloped top side edge 72 of the vent panel 12. Notably, the first and second sidewalls 16, 18 extend from the body 14 at an angle that is greater than 90 degrees from a bottom surface of the body 14. Stated differently, the first and second sidewalls 16, 18 extend outwardly such that the bottom edge 70 extends laterally further than the top edge 72 of the vent panel 12. In some embodiments, it is contemplated that the vent panel 12 may include a configuration of the plurality of flexure vanes 34 on both an inside surface and an outside surface of the first and second sidewalls 16, 18 (FIG. 3A). Alternatively, the plurality of flexure vanes 34 may be only positioned on the outside surface of the first and second sidewalls 16, 18 and the inside surface of the first and second sidewalls 16, 18 may be planar.

The plurality of flexure vanes 34 disclosed herein provide additional ventilation to the vent panel 12. More specifically, the non-linear configuration of the plurality of flexure vanes 34 results in increased airflow across the vent panel 12, as compared to vent panels that include a planar or flat sidewall.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A vent system including a plurality of vent panels, each vent panel comprising:

a body having first and second inclined sidewalls and first and second end walls, wherein each of the first and second end walls includes a first set of lateral vents and a second set of lateral vents, wherein the first set of lateral vents is disposed at a first angle relative to the first end wall and a second set of lateral vents is disposed at a second angle relative to the second end wall, wherein the first and second sets of lateral vents are at least partially co-planar with the respective first and second end walls;

a first arcuate vented portion extending from an outer edge of the top surface of the body to a top edge of the first inclined sidewall;

a second arcuate vented portion extending from another outer edge of the top surface of the body to a top edge of the second inclined sidewall, wherein the first and second arcuate vented portions each include laterally-extending vent supports that define a plurality of vent openings that support the flow of air therethrough;

a plurality of flexure vanes disposed on each of the first and second inclined sidewalls, wherein a flexure channel is disposed adjacent to each of the plurality of flexure vanes that allow for some flexure of the vent panel;

a plurality of primary buttresses disposed in a parallel arrangement on an underside of the plurality of vent panels, wherein each of the plurality of primary buttresses is disposed substantially normal to the body;

a plurality of secondary buttresses disposed parallel to the plurality of primary buttresses on the underside of the plurality of vent panels, the primary and secondary buttresses disposed in an alternating arrangement to provide increased flexibility to the first and second arcuate vented portions and the plurality of flexure vanes, wherein the secondary buttresses are linear members positioned solely within the body portion and are free of engagement with the first and second arcuate vented portions; and a plurality of weep holes disposed on each of the first and second inclined sidewalls.

2. The vent system of claim 1, wherein the plurality of flexure vanes are disposed on an outside surface of each of the first and second inclined sidewalls.

3. The vent system of claim 1, wherein each of the plurality of flexure vanes have a substantially triangular cross-section.

4. The vent system of claim 1, wherein each of the first and second inclined sidewalls includes a top edge and a bottom edge, and wherein each of the plurality of flexure vanes flares outwardly from the bottom edge to the top edge.

5. The vent system of claim 4, wherein the plurality of flexure vanes define a scalloped top side edge of the vent panel.

6. The vent system of claim 5, wherein the plurality of flexure vanes terminate at a linear bottom side edge of the body.

7. A vent system including a plurality of vent panels, each vent panel comprising:

a body having first and second inclined sidewalls and first and second end walls, wherein each of the first and second end walls is at least partially defined by a first set of lateral vents and a second set of lateral vents, respectively, wherein the first set of lateral vents is disposed at a first angle relative to the first end wall and a second set of lateral vents is disposed at a second angle relative to the second end wall, wherein the first angle is different than the second angle;

a first arcuate vented portion being concave upward and disposed between a top edge of the first inclined sidewall and an outer edge of the body;

a second arcuate vented portion being concave upward and disposed between a top edge of the second inclined sidewall and another outer edge of the body, wherein the first and second arcuate vented portions each include laterally-extending vent supports that define a plurality of vent openings that support the flow of air therethrough;

a plurality of flexure vanes disposed on each of the first and second inclined sidewalls, wherein a flexure channel is disposed adjacent to each of the plurality of flexure vanes that support a flexion of a plurality of vent panels, and wherein the plurality of flexure vanes define a scalloped bottom side edge of the vent system; and a plurality of primary buttresses disposed in a parallel arrangement on an underside of the plurality of vent panels, wherein each of the plurality of primary buttresses is disposed substantially normal to the body.

8. The vent system of claim 7, wherein the plurality of flexure vanes are disposed only on an outside surface of each of the first and second inclined sidewalls.

9. The vent system of claim 7, further comprising:

a plurality of first and second flexure ridges having a substantially triangular cross-section.

10. The vent system of claim 7, wherein the first and second inclined sidewalls include a plurality of weep holes for releasing moisture disposed in the vent system.

11. The vent system of claim 7, wherein the plurality of flexure vanes terminate at a linear bottom side edge of each of the first and second inclined sidewalls.

12. The vent system of claim 7, wherein the plurality of flexure vanes terminate at a linear top side edge of the body.

13. A vent system including a plurality of vent panels, each vent panel comprising:

a body having a top wall and first and second inclined sidewalls, wherein the top wall includes a bottom surface and a top surface, and wherein the first and second inclined sidewalls are angled outward to extend from the top wall at an angle greater than 90 degrees from the bottom surface of the top wall;

a first arcuate vented portion disposed between a top edge of the first inclined sidewall and an outer edge of the body;

a second arcuate vented portion disposed between a top edge of the second inclined sidewall and another outer edge of the body, wherein the first and second arcuate vented portions each include laterally-extending arcuate vent supports that define a plurality of arcuate vent openings;

a plurality of flexure vanes disposed on each of the first and second inclined sidewalls, wherein a flexure channel is disposed adjacent to each of the plurality of flexure vanes that support a flexion of a plurality of vent panels, and wherein the plurality of flexure vanes define a scalloped top side edge of the vent system; and a plurality of primary buttresses disposed in a parallel arrangement on an underside of the plurality of vent panels, wherein each of the plurality of primary buttresses is disposed substantially normal to the body and wherein a portion of the primary buttresses engage the first inclined sidewall at the angle greater than 90 degrees with respect to the body.

14. The vent system of claim 13, further comprising:

a plurality of secondary buttresses disposed parallel to the plurality of primary buttresses on the underside of the plurality of vent panels, the primary and secondary buttresses disposed in an alternating arrangement to provide increased flexibility to the first and second arcuate vented portions and the plurality of flexure vanes, and wherein at least one of the primary buttresses are fixedly engaged to the body and one of the first and second inclined sidewalls, and wherein at least one of the primary buttresses are fixedly engaged to the body and the other of the first and second inclined sidewalls.

15. The vent system of claim 13, wherein the plurality of flexure vanes are disposed only on an outside surface of each of the first and second inclined sidewalls.

16. The vent system of claim 13, further comprising:

a plurality of first and second flexure ridges has a substantially triangular cross-section.

17. The vent system of claim 13, wherein the first and second inclined sidewalls include a plurality of weep holes for releasing moisture disposed in the vent system.

* * * * *